United States Patent [19]

Streich et al.

[11] Patent Number: 4,918,414

[45] Date of Patent: Apr. 17, 1990

[54] ELECTROMAGNETIC SWITCHING DEVICE

[75] Inventors: Georg Streich, Amberg; Guenter Gnahn, Sulzbach-Rosenberg; Kurt Held, Amberg, all of Fed. Rep. of Germany

[73] Assignee: Siemens Aktiengesellschaft, Berlin & Munich, Fed. Rep. of Germany

[21] Appl. No.: 382,736

[22] Filed: Jul. 19, 1989

[30] Foreign Application Priority Data

Sep. 5, 1988 [DE] Fed. Rep. of Germany ..... 8811205

[51] Int. Cl.[4] ..... H01F 7/13

[52] U.S. Cl. ..... 335/274; 335/270

[58] Field of Search ..... 335/258, 269, 270, 274, 335/276, 277

[56] References Cited

U.S. PATENT DOCUMENTS

| | | | |
|---|---|---|---|
| 1,709,571 | 4/1929 | Harrison | 335/274 X |
| 3,878,491 | 4/1975 | Rauter et al. | 335/270 |

FOREIGN PATENT DOCUMENTS

| | | | |
|---|---|---|---|
| 1244919 | 7/1967 | Fed. Rep. of Germany | 335/270 |
| 2307283 | 8/1974 | Fed. Rep. of Germany | 335/274 |
| 2348672 | 4/1975 | Fed. Rep. of Germany | 335/274 |

*Primary Examiner*—George Harris

*Attorney, Agent, or Firm*—Kenyon & Kenyon

[57] ABSTRACT

An electromagnetic switching device includes a mechanism to couple the magnet armature with its contact carrier. A plate spring is provided with cylindrical formations in its mid-section as well as on its opposite ends so that the plate spring can bend beyond its elongated state. This prevents the spring tension from being altered by contact with the ends of the opening of the magnet armature and the ends of the supporting slots.

3 Claims, 1 Drawing Sheet

ELECTROMAGNETIC SWITCHING DEVICE

FIELD OF THE INVENTION

The invention relates to an electromagnetic switching device and, more particularly, to a switching device having a mechanism to connect the magnet armature with its contact carrier. The magnet armature has a through passage, near a side away from the pole faces, which is penetrated with a plate spring. The ends of the plate spring protrude out of the magnet armature and engage with two oppositely located slots on the contact carrier.

BACKGROUND OF THE INVENTION

In prior known electromagnetic switching devices, such as the one shown in German Design Patent 84 31 937, the range of motion of the armature is restricted by a cross-member situated below the plate spring, i.e., the plate spring can only be forced into an elongated state and no further. If the cross-member is removed from this type of arrangement, the plate spring is able to bend further. However, when the plate spring rests on the edges of the through-passage, the supporting points undergo an alteration such that the spring characteristic of the plate spring is suddenly changed.

Thus, there is a need for a switching device of the above-mentioned type providing the longest possible magnet armature travel while still maintaining the spring characteristic of the plate spring.

SUMMARY OF THE INVENTION

The above problems of the prior art electromagnetic switchgear devices are overcome by providing a plate spring whose mid-section has a cylindrical formation in the area of penetration in the armature. The cylindrical formation projects in the spring's return direction and has it's longitudinal axis running diagonally to the longitudinal axis of the plate spring.

In addition, to prevent the plate spring from resting on the edges formed by the slot of the plate spring when extended its greatest possible deflection distance, it is advantageous to provide additional cylindrical formations which run parallel to the first mid-section cylindrical formation. The additional cylindrical formations should be on the side of the plate spring lying opposite the first cylindrical formation, the ends of the plate spring thereby engaging with the slots.

To prevent the plate spring from moving out of the holding device during operation, one end of the plate spring is extended beyond one of the other additional cylindrical formations. The extended end of the plate spring is slotted and provided with external, claw-shaped, tip-stretched formations.

DETAILED DESCRIPTION

Figure 1:
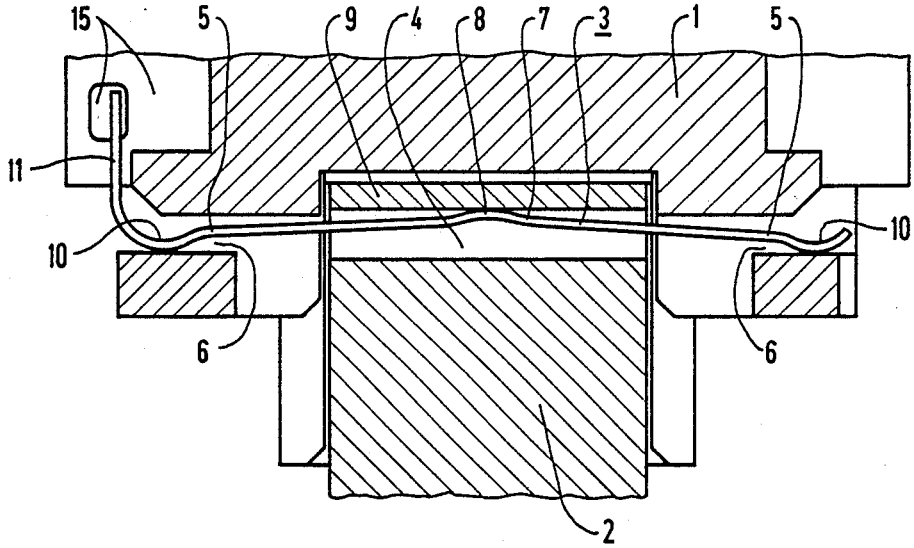
FIG. 1 is a basic representation of a lateral, cross-sectional view of the coupling between the magnet armature and the carrier.
Figure 3:
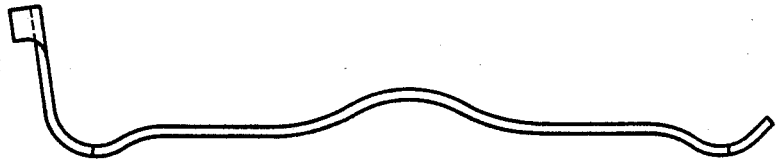
FIG. 3 is a lateral view of the plate spring of the present invention.

Referring to FIG. 1, there is shown a part of an electromagnetic switching device illustrating a section of the contact carrier 1 and the magnet armature 2. The magnet armature 2 is guided in the contact carrier 1 and is retained on the contact carrier 1 by means of a plate spring 3. The plate spring 3 penetrates a rectangular opening or through passage 4 in the magnet armature 2 which runs diagonally to the lamination alignment of the magnet armature 2. The ends 5 of the plate spring 3 are supported in slits or slots 6. The midsection 7 of the plate spring 3 has a cylindrical formation 8. The cylindrical formation 8 is braced against the wall 9 of the opening 4.

Figure 2:
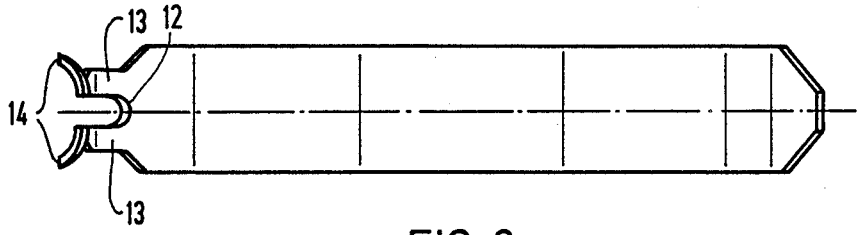
FIG. 2 is a top view of the plate spring of the present invention.

Additional cylindrical formations 10 lie on the opposite side of the plate spring 3 relative to the cylindrical formation 8. Located beyond one of the additional cylindrical formations 10 of the plate spring 3 is an extension 11. The extension 11, as shown in FIG. 2, is furnished with a slit 12. Claw-shaped, tip-stretched formations 14 are provided on the arms 13 formed by the slit 12. After insertion, the claw-shaped formations couple mechanically to the walls of a corresponding recess 15 in the contact carrier 1.

In operation, if the magnet armature 2 is pulled upward by the reverse magnet section, then the plate spring 3, in its elongated state, will not contact the wall 9. Therefore, there is no change in the spring supporting points. Also, the plate spring 3, in its elongated state, does not immediately contact the edges of the bottom walls of the slots 6 which would alter the supporting points of the plate spring 3 Rather, in accordance with the construction of the cylindrical formations, the plate spring 3 is able to bend a relatively far distance beyond the elongated state of the plate spring 3, thus permitting a relatively long travel distance for the magnet armature 2.

As shown in FIG. 1, the bottom walls of the slots 6 are set back from the magnet armature 2 as far as possible in the direction of the formations 10. Alternatively, the bottom walls of the slots 6 can be eliminated.

The plate spring 3 can be made to have a suitable rigid construction, so that this type of spring deflection, e.g., a relatively long travel distance, will only occur when the contact carrier is restrained. For example, this type of spring deflection will occur in the case of welded contacts. The cylindrical formations do not necessarily have to be of a cylindrical shape. For the most part, the same effect is achieved with a prism or a spherical formation.

What is claimed is:

1. An electromagnetic switching device having a polar surface, comprising:

a. a magnet armature having an opening at one end away from said polar surface;

b. a contact carrier having oppositely disposed slots;

c. a mechanism for coupling the magnet armature with said contact carrier further including:

i. a plate spring located in said opening of the magnet armature and having its ends protrude out of said armature and engage with said slots; and ii. said plate spring have a first cylindrical formation located in the middle of said plate spring inside of said opening, said first formation projecting in the plate spring's return direction and having a longitudinal axis running across the longitudinal axis of the plate spring.

2. A switching device according to claim 1 wherein the ends of said plate spring engaging said slots have an additional cylindrical formation which is parallel to said first formation and located on the opposite side of said first formation.

3. A switching device according to claim 2 wherein one end of said plate spring extends beyond the additional cylindrical formation, said one end having a slot which is provided with an external claw-shaped formation.

* * * * *